US009563156B2

(12) United States Patent
Nanjo

(10) Patent No.: US 9,563,156 B2
(45) Date of Patent: Feb. 7, 2017

(54) FIXING DEVICE INCLUDING DETECTING MECHANISM WHICH DETECTS INFRARED RAYS RADIATED FROM HEATING BODY AND IMAGE FORMING APPARATUS INCLUDING SAME

(71) Applicant: KYOCERA Document Solutions Inc., Osaka-shi, Osaka (JP)

(72) Inventor: Yuzuru Nanjo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/986,939

(22) Filed: Jan. 4, 2016

(65) Prior Publication Data

US 2016/0202647 A1 Jul. 14, 2016

(30) Foreign Application Priority Data

Jan. 13, 2015 (JP) ..... 2015-003826

(51) Int. Cl.
*G03G 15/20* (2006.01)

(52) U.S. Cl.
CPC .. *G03G 15/2039* (2013.01); *G03G 2215/2035* (2013.01)

(58) Field of Classification Search
CPC ..... G03G 15/2039
USPC ..... 399/69
See application file for complete search history.

(56) References Cited

U.S. PATENT DOCUMENTS

2004/0109490 A1* 6/2004 Asakura ..... G01J 5/16 374/133

FOREIGN PATENT DOCUMENTS

| | | | | |
|---|---|---|---|---|
| JP | 60133328 | A | * | 7/1985 |
| JP | 2001228742 | A | | 8/2001 |
| JP | 2002323378 | A | * | 11/2002 |
| JP | 2003229242 | A | * | 8/2003 |
| JP | 2007328222 | A | * | 12/2007 |

* cited by examiner

*Primary Examiner* — Quana M Grainger
(74) *Attorney, Agent, or Firm* — Studebaker & Brackett PC

(57) ABSTRACT

A fixing device includes a heating body, a pressuring body, a heat source and a detecting mechanism. The detecting mechanism is not in contact with the heating body and including an infrared detecting element which detects infrared rays radiated from an outer circumferential face of the heating body. A longitudinal direction of the heating body is a second direction which crosses a first direction as a conveying direction of a recording medium. A detected area is arranged on the outer circumferential face of the heating body so that the infrared rays radiated from the detected area is detected by the infrared detecting element. The detecting mechanism is arranged in a posture inclined to another posture facing the outer circumferential face of the heating body so that a width in the second direction of the detected area is wider than a width in the first direction of the detected area.

8 Claims, 9 Drawing Sheets

FIXING DEVICE INCLUDING DETECTING MECHANISM WHICH DETECTS INFRARED RAYS RADIATED FROM HEATING BODY AND IMAGE FORMING APPARATUS INCLUDING SAME

INCORPORATION BY REFERENCE

This application is based on and claims the benefit of priority from Japanese Patent application No. 2015-003826 filed on Jan. 13, 2015, the entire contents of which are incorporated herein by reference.

BACKGROUND

The present disclosure relates to a fixing device configured to fix a toner image onto a recording medium and an image forming apparatus including the fixing device.

Conventionally, an electrographic image forming apparatus, such as a copying machine or a printer, includes a fixing device configured to fix a toner image onto a recording medium, such as a sheet.

For example, there is a fixing device including a heating body, a pressuring body configured to come into pressure contact with the heating body so as to form a fixing nip, a heat source configured to heat the heating body and a detecting mechanism configured to be not in contact with the heating body.

There is a case that the above-mentioned detecting mechanism includes an infrared detecting element, such as a thermopile. In such a case, the infrared detecting element detects infrared rays radiated from an outer circumferential face of the heating body, and a temperature of the heating body is calculated on a basis of a detecting value thereof or the like.

In the fixing device with above-mentioned configuration, temperature distribution of the heat source is normally not uniform, so that temperature distribution of the heating body heated by the heat source is not uniform, either.

Accordingly, there is fear that detecting accuracy of the infrared detecting element is deteriorated, because a detecting value of the infrared detecting element in a case where the infrared detecting element detects infrared rays radiated from the hottest part in the outer circumferential face of the heating body is greatly different from a detecting value of the infrared detecting element in another case where the infrared detecting element detects infrared rays radiated from the coldest part in the outer circumferential face of the heating body.

Further, in the fixing device with above-mentioned configuration, there is fear that it becomes difficult to dispose the detecting mechanism in a case where the detecting mechanism is greatly protruded toward an outer diameter side of the heating body.

SUMMARY

In accordance with an embodiment of the present disclosure, a fixing device includes a heating body, a pressuring body, a heat source and a detecting mechanism. The heating body is configured to be rotatable. The pressuring body is configured to be rotatable and to come into pressure contact with the heating body so as to forma fixing nip. The heat source is configured to heat the heating body. The detecting mechanism is configured to be not in contact with the heating body and including an infrared detecting element which detects infrared rays radiated from an outer circumferential face of the heating body. A longitudinal direction of the heating body is a second direction which crosses a first direction as a conveying direction of a recording medium. A detected area is arranged on the outer circumferential face of the heating body so that the infrared rays radiated from the detected area is detected by the infrared detecting element. The detecting mechanism is arranged in a posture inclined to another posture facing the outer circumferential face of the heating body so that a width in the second direction of the detected area is wider than a width in the first direction of the detected area.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
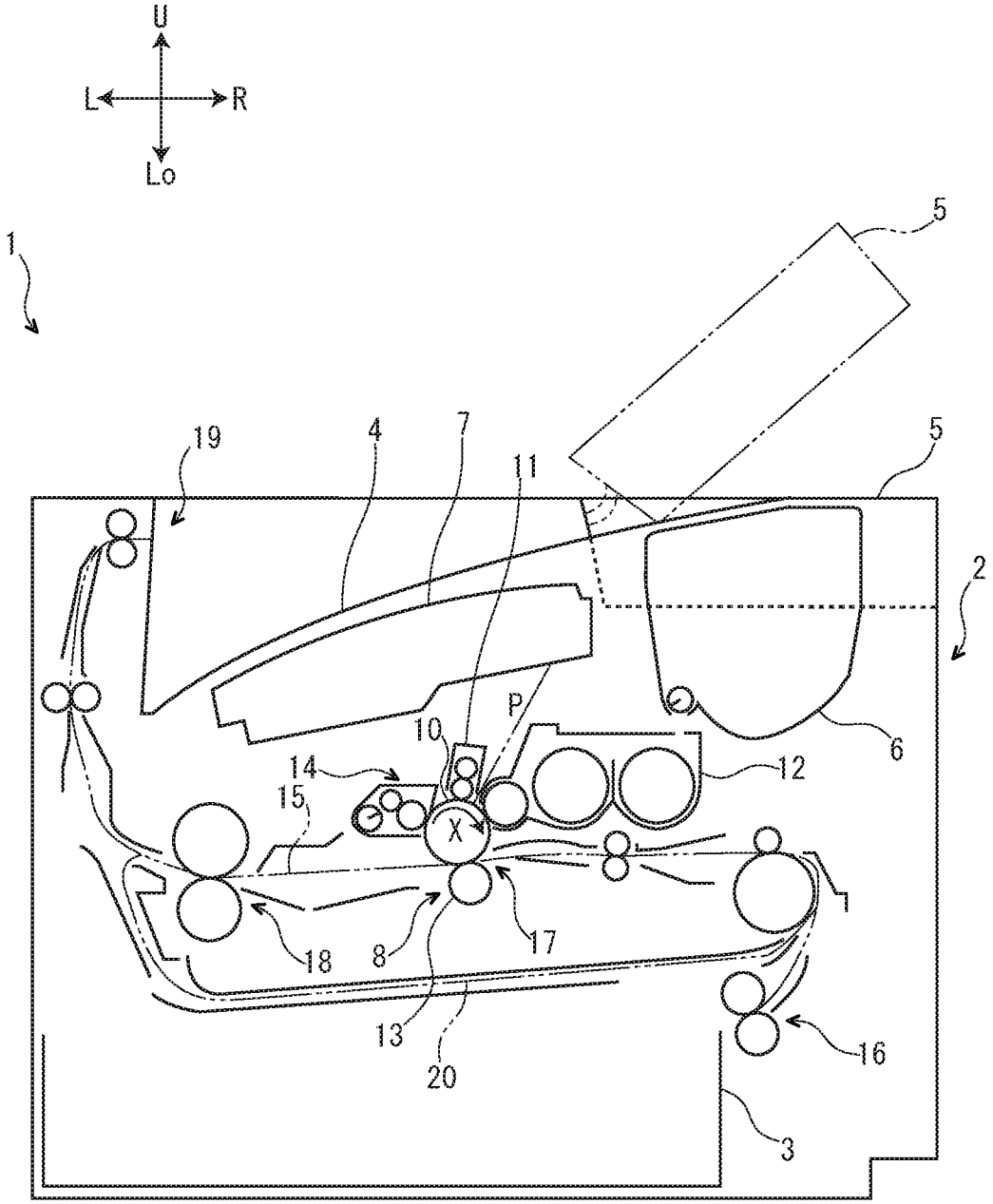
FIG. 1 is a schematic view showing an outline of a printer according to an embodiment of the present disclosure.

First, with reference to FIG. 1, the entire structure of a printer 1 (an image forming apparatus) will be described. Arrows Fr, Rr, L, R, U and Lo appropriately added to each of the drawings indicate the front side, rear side, left side, right side, upper side and lower side of the printer 1, respectively.

The printer 1 includes a box-formed printer main body 2. In a lower part of the printer main body 2, a sheet feeding cartridge 3 configured to store sheets (recording medium) is installed and, on the top surface of the printer main body 2, a sheet ejecting tray 4 is mounted. On the top surface of the printer main body 2, an upper cover 5 is openably/closably attached at a right side of the sheet ejecting tray 4 and, below the upper cover 5, a toner container 6 is installed.

In an upper part of the printer main body 2, an exposure device 7 composed of a laser scanning unit (LSU) is installed below the sheet ejecting tray 4. Below the exposure device 7, an image forming unit 8 is installed. In the image forming unit 8, a photosensitive drum 10 as an image carrier is rotatably installed. Around the photosensitive drum 10, a charger 11, a development device 12, a transfer roller 13 and a cleaning device 14 are located along a rotating direction (refer to arrow X in FIG. 1) of the photosensitive drum 10.

Inside the printer main body 2, a sheet conveying path 15 is arranged. At an upper stream end of the conveying path 15, a sheet feeder 16 is positioned. At an intermediate stream part of the conveying path 15, a transferring unit 17 constructed of the photosensitive drum 10 and transfer roller 13 is positioned. At a lower stream part of the conveying path 15, a fixing device 18 is positioned. At a lower stream end of the conveying path 15, a sheet ejecting unit 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data on the photosensitive drum 10 is carried out by a laser (refer to two-dot chain line P in FIG. 1) from the exposure device 7, thereby forming an electrostatic latent image on the surface of the photosensitive drum 10. Subsequently, the electrostatic latent image is developed to a toner image with a toner (a developer) in the development device 12.

On the other hand, a sheet fed from the sheet feeding cartridge 3 by the sheet feeder 16 is conveyed to the transferring unit 17 in a suitable timing for the above-mentioned image forming operation, and then, the toner image on the photosensitive drum 10 is transferred onto the sheet in the transferring unit 17. The sheet with the transferred toner image is conveyed to a lower stream on the conveying path 15 to go forward to the fixing device 18, and then, the toner image is fixed on the sheet in the fixing device 18. The sheet with the fixed toner image is ejected from the sheet ejecting unit 19 to the sheet ejecting tray 4. Toner remained on the photosensitive drum 10 is collected by the cleaning device 14.

Next, the fixing device 18 will be described with reference to FIGS. 2 to 5. Arrow I in FIGS. 2 and 5 indicates an inside in a front and rear direction, and arrow O in FIGS. 2 and 5 indicates an outside in the front and rear direction. Arrow Y in FIG. 3 indicates a sheet conveying direction.

Figure 2:
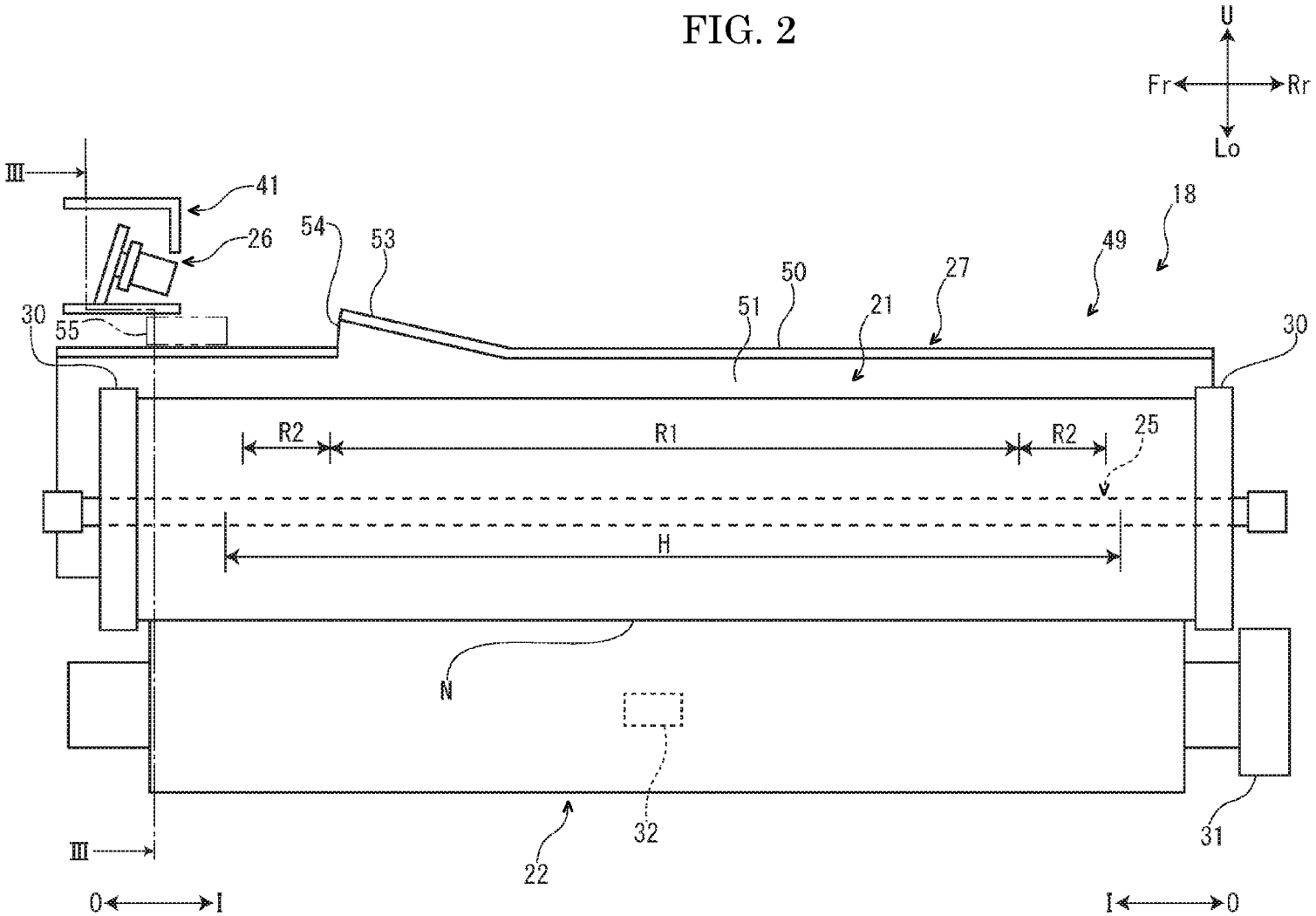
FIG. 2 is a side view showing a fixing device according to the embodiment of the present disclosure.
Figure 3:
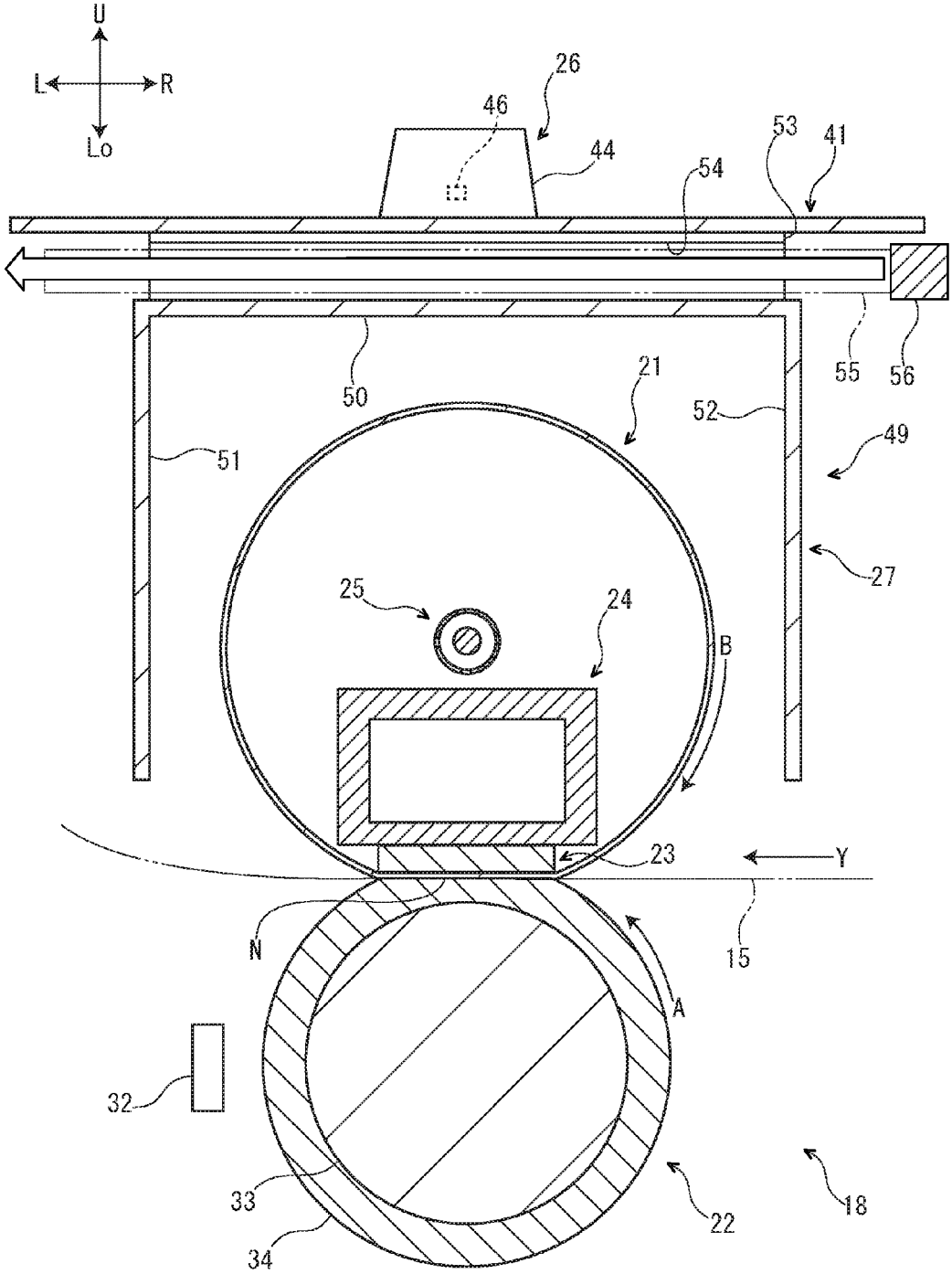
FIG. 3 is a sectional view taken along a III-III line of FIG. 2.

As shown in FIGS. 2 and 3, the fixing device 18 includes a fixing belt 21 (heating body), a pressuring roller 22 (pressuring body) arranged at a lower side (outer diameter side) of the fixing belt 21, a pressing member 23 arranged at an inner diameter side of the fixing belt 21, a supporting member 24 arranged at the inner diameter side of the fixing belt 21 and at an upper side of the pressing member 23, a halogen lamp 25 (heat source) arranged at the inner diameter side of the fixing belt 21 and at the upper side of the supporting member 24, a detecting mechanism 26 arranged at an upper front side (outer diameter side) of the fixing belt 21, and a heat insulating member 27 arranged between the fixing belt 21 and the detecting mechanism 26.

A longitudinal direction of the fixing belt 21 is the front and rear direction (second direction) which is orthogonal to (crosses) a left and right direction (first direction) as the sheet conveying direction. The fixing belt 21 is formed in a nearly cylindrical shape. The fixing belt 21 has flexibility, and is endless in a circumferential direction. The fixing belt 21 is rotatably provided. At both front and rear end parts of the fixing belt 21, caps 30 are attached.

In an outer circumferential face of the fixing belt 21, a center area R1 and end part areas R2 formed at both front and rear sides of the center area R1 (closer to an outside in the front and rear direction than the center area R1) are arranged. The center area R1 is an area through which first size sheets (e.g. maximum size sheets) and second size sheets (e.g. minimum size sheets) pass. Each end part area R2 is an area through which each first size sheet passes and each second size sheet does not pass.

The fixing belt 21 includes, for example, a base material layer, an elastic layer provided around this base material layer and a release layer covering this elastic layer. The base material layer of the fixing belt 21 is formed by nickel electroforming, for example. A thickness of the base material layer of the fixing belt 21 is 35 μm, for example. The elastic layer of the fixing belt 21 is made of a silicon rubber, for example. A thickness of the elastic layer of the fixing belt 21 is 200 μm, for example. The release layer of the fixing belt 21 is made of a PFA, for example. A thickness of the release layer of the fixing belt 21 is 30 μm, for example. In addition, in each drawing, each layer (the base layer, the elastic layer and the release layer) of the fixing belt 21 is not distinguished in particular.

A longitudinal direction of the pressuring roller 22 is the front and rear direction. The pressuring roller 22 is formed in a nearly columnar shape. The pressuring roller 22 comes into contact with the fixing belt 21 so as to forma fixing nip N between the fixing belt 21 and the pressuring roller 22. The pressuring roller 22 is rotatably provided. To a rear end part of the pressuring roller 22, a drive gear 31 is fixed. A temperature sensor 32 faces a left side part of the pressuring roller 22 with an interval. The temperature sensor 32 is composed of, for example, a thermistor.

For example, the pressuring roller 22 includes a columnar core material 33, an elastic layer 34 provided around this core material 33 and a release layer (not shown) covering this elastic layer 34. The core material 33 of the pressuring roller 22 is made of a metal, such as an aluminum, for example. The elastic layer 34 of the pressuring roller 22 is made of a silicon sponge rubber, for example. A thickness of the elastic layer 34 of the pressuring roller 22 is 3.5 mm, for example. The release layer (not shown) of the pressuring roller 22 is made of a PFA tube, for example. A thickness of the release layer of the pressuring roller 22 is 50 μm, for example.

A longitudinal direction of the pressing member 23 is the front and rear direction. The pressing member 23 is made of a heat resistant resin, such as an LCP (Liquid Crystal Polymer). A lower face of the pressing member 23 presses the fixing belt 21 toward a lower side (a side of the pressuring roller 22).

A longitudinal direction of the supporting member 24 is the front and rear direction. The supporting member 24 is made of a metal, such as a SUS, and is formed in a square cylindrical shape. An upper face of the pressing member 23 comes into contact with a lower face of the supporting member 24.

A longitudinal direction of the halogen lamp 25 is the front and rear direction. The halogen lamp 25 is arranged at a nearly center part of an internal space of the fixing belt 21.

Figure 4A:
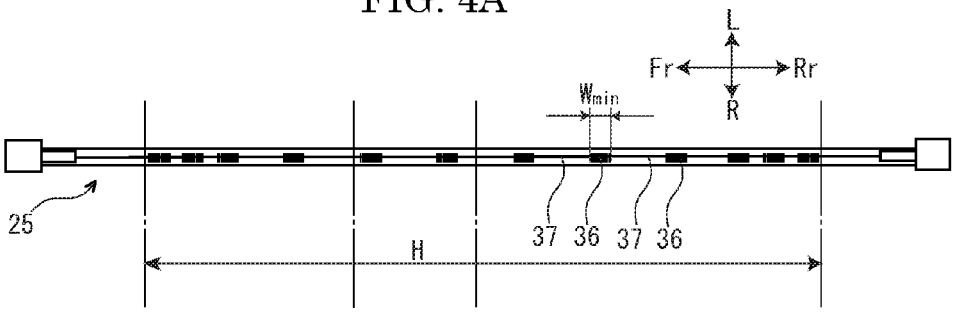
FIG. 4A is a plan view showing a halogen lamp, in the fixing device according to the embodiment of the present disclosure.

As shown in FIG. 4A and other figures, the halogen lamp 25 is provided with a heat generating area H. The heat generating area H includes a filament of a coil shape. A width in the front and rear direction of the heat generating area H is 300 mm, for example. In the heat generating area H, a plurality of bright spot parts 36 and a plurality of dark spot parts 37 provided between a plurality of the bright spot parts 36 are formed, because the filament is not wound uniformly. Each dark spot part 37 has a lower filament winding density than each bright spot part 36, and therefore has a smaller heat generating value than each bright spot part 36. Widths in the front and rear direction of a plurality of bright spot parts 36 is not uniform. The width in the front and rear direction of a bright spot part 36 which has the smallest widths in the front and rear direction among a plurality of the bright spot parts 36 will be referred to as a "minimum bright spot width Wmin". In the present embodiment, the minimum bright spot width Wmin is 10 mm.

Figure 5:
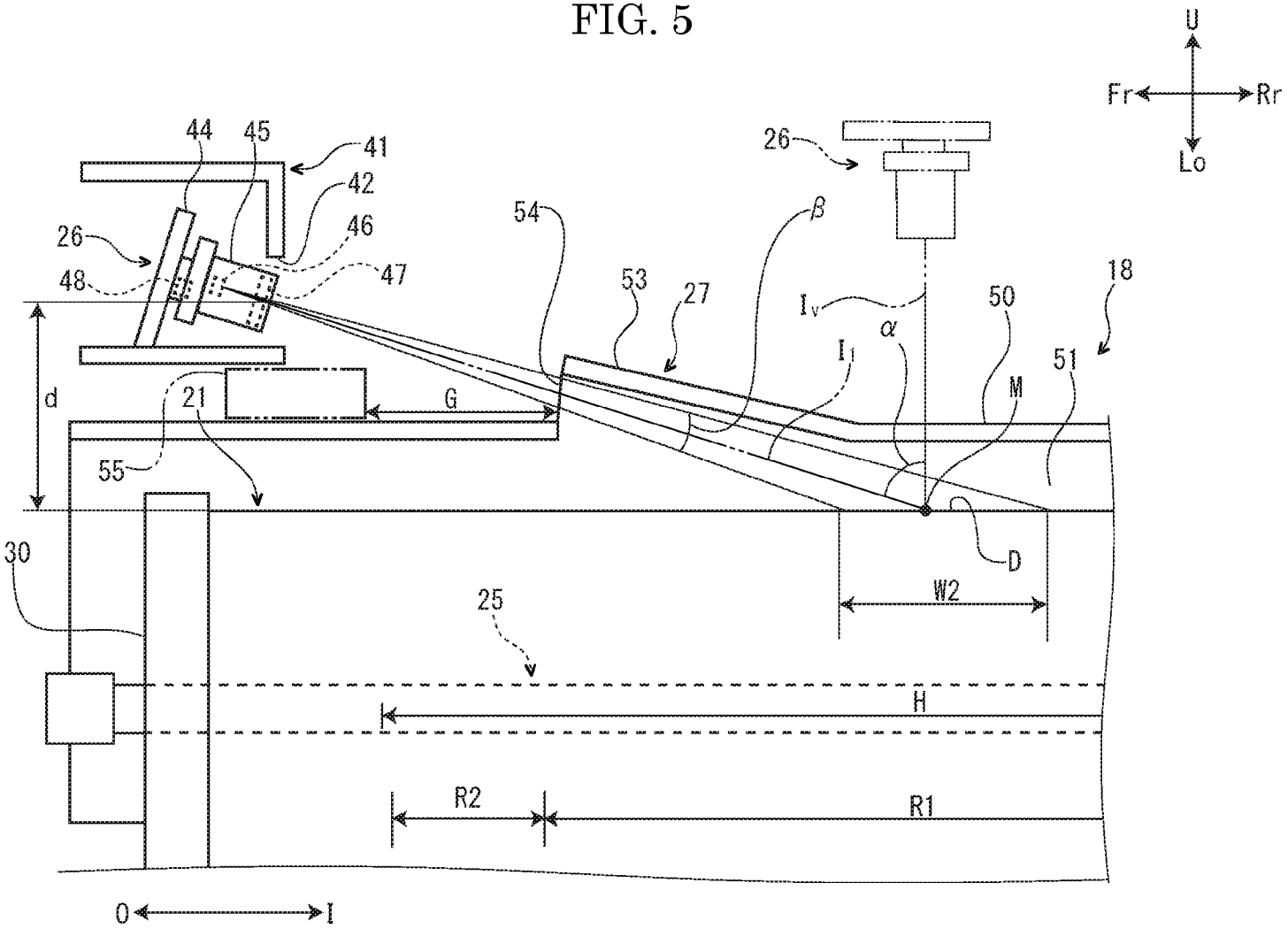
FIG. 5 is a side view showing an upper front part of the fixing device according to the embodiment of the present disclosure.

As shown in FIG. 5 and other figures, the detecting mechanism 26 is not in contact with the fixing belt 21. The detecting mechanism 26 is arranged closer to a front side (an outside in the front and rear direction) than the heat generating area H of the halogen lamp 25.

The detecting mechanism 26 is housed in a housing 41 which composes a part of a main body frame (a frame of the printer main body 2). At a rear lower part of the housing 41, a cutout part 42 is provided. In addition, FIG. 3 shows only a lower part of the housing 41, and does not show parts other than the lower part of the housing 41.

Figure 4B:
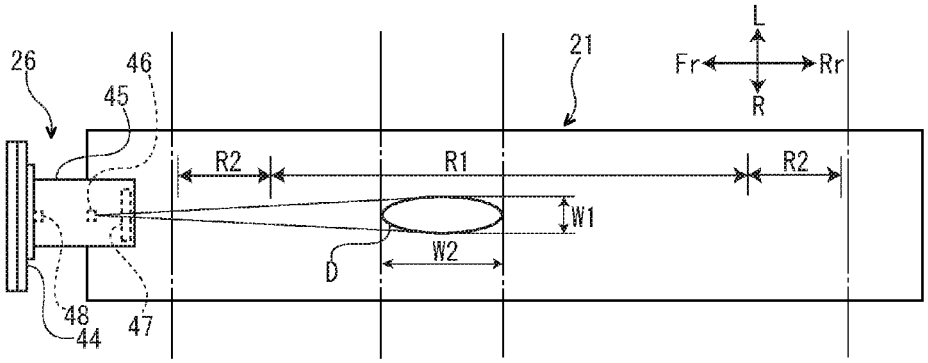
FIG. 4B is a plan view showing a fixing belt and a detecting mechanism, in the fixing device according to the embodiment of the present disclosure.

As shown in FIGS. 4B and 5, the detecting mechanism 26 includes a substrate 44 attached to the lower part of the housing 41, a main body 45 of a cylindrical shape fixed to the substrate 44, a thermopile 46 (infrared detecting element) housed in a nearly center part of the main body 45, a lens 47 housed in a rear end part of the main body 45 and a thermistor 48 (temperature detecting element) provided at a front end side of the main body 45.

The thermopile 46 of the detecting mechanism 26 has a function of detecting infrared rays I1 (hereinafter, simply referred to as the "infrared rays I1") diagonally radiated from the center area R1 of the fixing belt 21, and, in the center area R1 of the fixing belt 21, a detected area D is arranged so that the infrared rays I1 radiated from the detected area D are detected by the thermopile 46.

The detecting mechanism 26 is arranged in a posture inclined to a posture (see a two-dot chain line in FIG. 5) facing an outer circumferential face of the fixing belt 21. In the present embodiment, an inclined angle a of the detecting mechanism 26 with respect to the posture facing the outer circumferential face of the fixing belt 21 (also corresponding to an inclined angle of the infrared rays I1 with respect to infrared rays Iv vertically radiated from the detected area D of the fixing belt 21) is 70°.

The detecting mechanism 26 is arranged in the posture inclined to the posture facing the outer circumferential face of the fixing belt 21 as described above, and therefore the detected area D of the fixing belt 21 is formed in an elliptical shape, not a precise circular shape. Hence, a width W2 in the front and rear direction of the detected area D is wider than a width W1 in the left and right direction of the detected area D. In addition, a point M in FIG. 5 indicates a part of the detected area D which corresponds to a center part in the front and rear direction of the heat generating area H of the halogen lamp 25 with regard to a position in the forward and backward direction.

The lens 47 of the detecting mechanism 26 includes a function of focusing the infrared rays I1 on the thermopile 46. In other words, the lens 47 includes a function of narrowing a viewing angle β of the thermopile 46. Thus, it is possible to prevent the thermopile 46 from detecting infrared rays radiated from members other than the fixing belt 21. In the present embodiment, the viewing angle β of the thermopile 46 is 5° , a distance d from the detecting mechanism 26 to the outer circumferential face of the fixing belt 21 is 50 mm, and the width W2 in the front and rear direction of the detected area D of the fixing belt 21 is 44 mm. Thus, the width W2 (44 mm) in the front and rear direction of the detected area D is not less than four times the minimum bright spot width Wmin (10 mm). The thermistor 48 of the detecting mechanism 26 is a temperature sensor for compensating for a temperature, and has a function of detecting an atmospheric temperature of the detecting mechanism 26.

The heat insulating member 27 (see FIGS. 2, 3 and 5 and other figures) composes a part of the fixing frame (the frame of the fixing device 18). In this regard, in addition to the heat insulating member 27, the fixing frame includes a part which covers a lower side of the pressuring roller 22 and parts which cover both front and rear sides of the fixing belt 21 and the pressuring roller 22. However, each drawing shows only the heat insulating member 27 of the fixing frame and does not show parts other than the heat insulating member 27 of the fixing frame.

The heat insulating member 27 includes an upper wall part 50 which covers an upper side of the fixing belt 21, and a left wall part 51 and a right wall part 52 which are bent downward from both left and right end parts of the upper wall part 50 and cover both left and right sides of the fixing belt 21. In addition, FIGS. 2 and 5 do not show the right wall part 52.

The upper wall part 50 of the heat insulating member 27 is elongated along the front and rear direction. At a front part of the upper wall part 50, an inclined part 53 is bent up toward an upper side (a side of the detecting mechanism 26). The inclined part 53 is inclined with respect to the front and rear direction. At a front end side of the inclined part 53, at a part corresponding to an optical path of the infrared rays I1, an opening 54 is formed such that the heat insulating member 27 does not insulate the infrared rays I1.

Between the detecting mechanism 26 and the housing 41, and the upper wall part 50 of the heat insulating member 27, a flow passage 55 of cooling air is arranged so that the flow passage 55 is spaced away from the opening 54 at an interval G. The flow passage 55 is arranged along the left and right direction (the direction which is orthogonal to (crosses) the front and rear direction). At an upstream end part (a right end part in the present embodiment) of the flow passage 55, a fan 56 is arranged, and cooling air provided from the fan 56 to the flow passage 55 flows in the flow passage 55 along the left and right direction.

As shown in FIGS. 2 and 3 and other figures, parts except for the detecting mechanism 26, the housing 41 and the fan 56 of the fixing device 18 compose a fixing unit 49. The fixing unit 49 is detachable from the printer main body 2.

Figure 6:
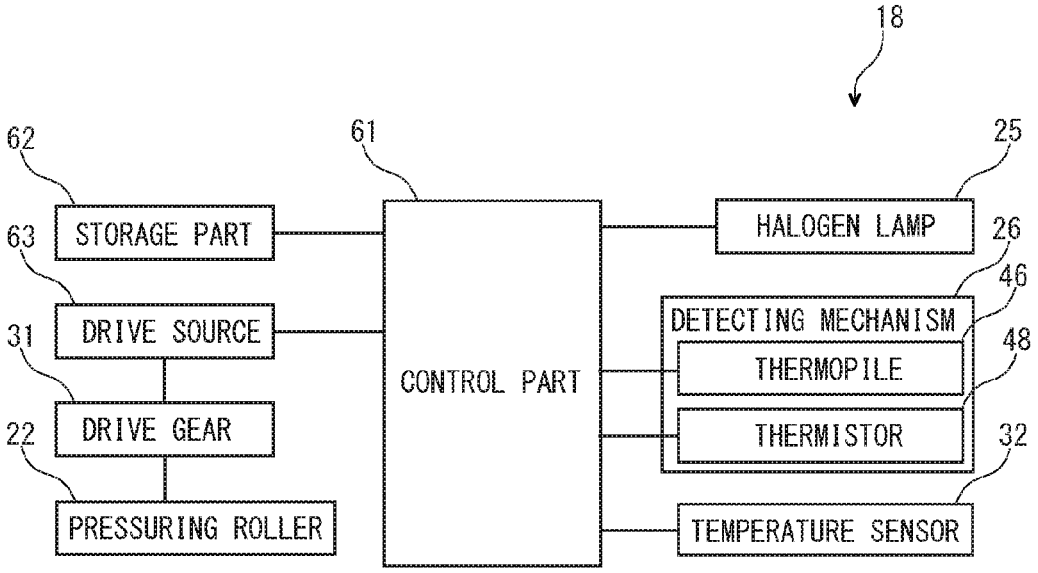
FIG. 6 is a block diagram showing a control system of the fixing device according to the embodiment of the present disclosure.

Next, a control system of the fixing device 18 will be described with reference to FIG. 6.

The fixing device 18 includes a control part 61. The control part 61 is connected with a storage part 62 configured as a storage device, such as a ROM or a RAM, and the control part 61 is configured to control each part of the fixing device 18 on the basis of a control program or control data stored in the storage part 62.

The control part 61 is connected to a drive source 63 configured as a motor or the like, and the drive source 63 is connected to the pressuring roller 22 via the drive gear 31. Further, on the basis of a signal from the control part 61, the drive source 63 rotates the pressuring roller 22.

The control part 61 is connected to the halogen lamp 25. Further, when power is supplied to the halogen lamp 25 on the basis of a signal from the control part 61, the halogen lamp 25 is lighted up, and the heat generating area H of the halogen lamp 25 generates heat.

The control part 61 is connected to the thermopile 46 of the detecting mechanism 26, and, when the thermopile 46 detects the infrared rays I1, the thermopile 46 outputs a detecting value to the control part 61. The control part 61 is connected to the thermistor 48 of the detecting mechanism and, when the thermistor 48 detects an atmospheric temperature of the detecting mechanism 26, the thermistor 48 outputs a detecting value to the control part 61.

The control part 61 is connected to the temperature sensor 32 and, when the temperature sensor 32 detects a temperature of the pressuring roller 22, the temperature sensor 32 outputs a detecting value to the control part 61.

When a toner image is fixed onto a sheet in the fixing device 18 configured as described above, on the basis of a signal from the control part 61, the drive source 63 rotates the pressuring roller 22 (see arrow A in FIG. 3) . When the pressuring roller 22 is rotated in this way, the fixing belt 21 which comes into pressure contact with the pressuring roller 22 is driven to be rotated in a direction opposite to a direction of the pressuring roller 22 (see arrow B in FIG. 3).

Further, when a toner image is fixed onto a sheet, on the basis of a signal from the control part 61, the halogen lamp 25 is lighted up. When the halogen lamp 25 is lighted up in this way, the heat generating area H of the halogen lamp 25 generates the heat so as to heat the fixing belt 21. When a sheet on which an unfixed toner image has been formed passes through the fixing nip N in this state, the toner mage is heated and melts and the toner image is fixed onto the sheet.

When the fixing belt 21 is heated as described above, the infrared rays I1 are radiated from the detected area D of the fixing belt 21. This infrared rays I1 pass through the opening 54 of the heat insulating member 27, are focused by the lens 47 of the detecting mechanism 26 and reach the thermopile 46 of the detecting mechanism 26. When the infrared rays I1 reach the thermopile 46 as described above, the thermopile 46 detects the infrared rays I1 and outputs a detecting value to the control part 61. Further, the thermistor 48 of the detecting mechanism 26 detects the atmospheric temperature of the detecting mechanism 26, and outputs a detecting value to the control part 61. The control part 61 calculates a temperature of the fixing belt 21 on the basis of the detecting value of the thermopile 46 and the detecting value of the thermistor 38. More specifically, the temperature of the fixing belt 21 is calculated from the following equation.

$$Vout=A(Tb^4-Ts^4)$$

Vout: detecting value of thermopile 46
A: proportionality constant
Tb: temperature of fixing belt 21 (K)
Ts: detecting value of thermistor 48

Compared to a case where only a temperature detecting member (e.g. thermistor) which comes into contact with the outer circumferential face of the fixing belt 21 is used as the detecting mechanism 26, by applying such a configuration, it is possible to enhance a responsivity of a calculated temperature of the fixing belt 21 to an actual temperature of the fixing belt 21, and support precise control. In the fixing device 18 whose energy saving performance is considered in particular, it is possible to realize low power upon a standby time of the fixing device 18 and activate the fixing device 18 up to a fixing temperature (a temperature at which a toner image can be fixed onto a sheet) at a high speed upon use of the fixing device 18.

Further, there is a concern that, when the temperature detecting member which comes into contact with the outer circumferential face of the fixing belt 21 detects the temperature of the fixing belt 21, the temperature detecting member damages the outer circumferential face of the fixing belt 21. When the outer circumferential face of the fixing belt 21 is damaged in this way, an exchange of the fixing belt 21 or an exchange of the entire fixing device 18 is required, and causes a rise in running cost of the fixing device 18. By contrast with this, in the present embodiment, the detecting mechanism 26 is not in contact with the fixing belt 21. Hence, there is no concern that the detecting mechanism 26 damages the outer circumferential face of the fixing belt 21, and it is possible to reduce a frequency to exchange the fixing belt 21 or the entire fixing device 18 and make the running cost of the fixing device 18 low.

Further, when the above contact-type temperature detecting member is used, the temperature detecting member is generally attached to the fixing unit 49. Hence, even when the temperature detecting member can be still used upon an exchange of the fixing unit 49, the temperature detecting member cannot not help being discarded together with the fixing unit 49, which is not preferable in terms of cost and resource saving. By contrast with this, in the present embodiment, the non-contact detecting mechanism 26 is attached to the housing 41 which forms a part of the frame of the printer main body 2. Consequently, it is not necessary to discard the detecting mechanism 26 together with the fixing unit 49 upon an exchange of the fixing unit 49, and it is possible to reduce cost and save resources.

Meanwhile, even when the above non-contact detecting mechanism 26 is used, there are the two following tasks.

First, the first task in case where the non-contact detecting mechanism 26 is used will be described. Similar to the present embodiment, to calculate the temperature of the fixing belt 21 on the basis of two detecting values (the detecting value of the thermopile 46 and the detecting value of the thermistor 48), an arithmetic operation amplifier circuit is necessary. Normally, taking a noise resistance into account, this arithmetic operation amplifier circuit is mounted on the main body 45 of the detecting mechanism 26. The arithmetic operation amplifier circuit has a low heat resistant temperature (normally about 100° C.), and therefore it is necessary to prevent a rise in the temperature of the detecting mechanism 26 caused by heat from the fixing belt 21.

Hence, in the present embodiment, the heat insulating member 27 is arranged between the fixing belt 21 and the detecting mechanism 26 and the flow passage 55 of cooling air is arranged between the detecting mechanism 26 and the heat insulating member 27, and the cooling air is provided from the fan 56 to this flow passage 55. By applying such a configuration, it is possible to prevent the rise in the temperature of the detecting mechanism 26.

However, there is a concern that, when the cooling air provided from the fan 56 flows to the vicinity of the opening 54 of the heat insulating member 27, viscosity of air attracts a heat near the fixing belt 21 to a space at the side of the detecting mechanism 26 via the opening 54 (the space above the heat insulating member 27 in the present embodiment), and the fixing belt 21 is unnecessarily cooled and energy saving performance of the fixing device 18 lowers.

Hence, in the present embodiment, the flow passage 55 of cooling air is spaced away from the opening 54 at the interval G. By applying such a configuration, the cooling air hardly flows near the opening 54, and therefore it is possible to prevent a heat near the fixing belt 21 from being attracted to the space at the side of the detecting mechanism 26 via the opening 54, and avoid that the fixing belt 21 is unnecessarily cooled. According to this, it is possible to enhance energy saving performance of the fixing device 18.

Figure 4C:
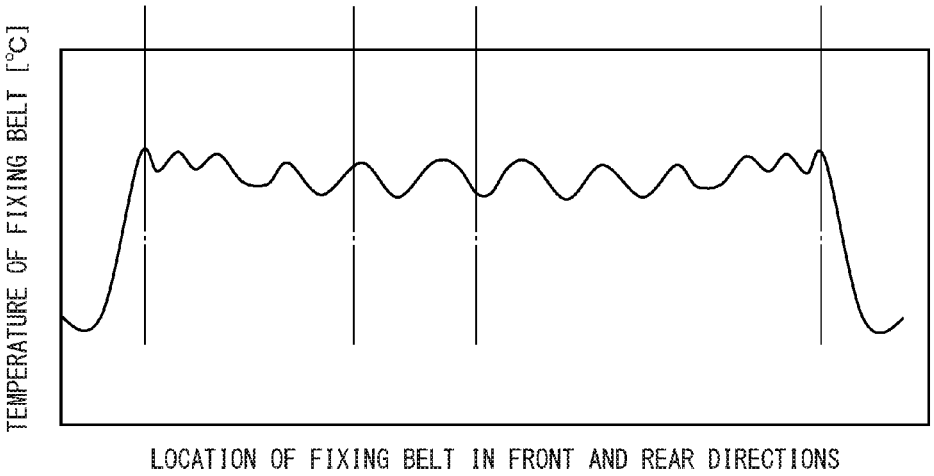
FIG. 4C is a graph showing a relationship between a location of the fixing belt in front and rear direction and a temperature of the fixing belt, in the fixing device according to the embodiment of the present disclosure.

Next, the second task in case where the non-contact detecting mechanism 26 is used will be described. In the present embodiment, the halogen lamp 25 is used as a heat source which heats the fixing belt 21, and, in the heat generating area H of this halogen lamp 25, a plurality of bright spot parts 36 and a plurality of dark spot parts 37 are formed because the filament is not wound uniformly. Hence, in the heat generating area H of the halogen lamp 25, a temperature distribution is not uniform in the front and rear direction, and, in the fixing belt 21 heated by the heat generating area H of the halogen lamp 25, the temperature distribution is not uniform in the front and rear direction, either. More specifically, as shown in FIG. 4C, at a part which overlaps each bright spot part 36 of the halogen lamp 25 with regard to a position in the front and rear direction, a temperature of the outer circumferential face of the fixing belt 21 is high, and, at a part which overlaps each dark spot part 37 of the halogen lamp 25 with regard to a position in the front and rear direction, the temperature of the outer circumferential face of the fixing belt 21 is low. Hence, there is fear that detecting accuracy of the thermopile 46 is deteriorated, because a detecting value of the thermopile 46 in a case where the thermopile 46 detects infrared rays radiated from the hottest part in the outer circumferential face of the fixing belt 21 is greatly different from a detecting value of the thermopile 46 in another case where the thermopile 46 detects infrared rays radiated from the coldest part in the outer circumferential face of the fixing belt 21.

When the viewing angle β of the thermopile 46 is simply widened to prevent the detecting accuracy of the thermopile 46 from being deteriorated, there is a concern that the thermopile 46 detects the infrared rays radiated from members other than the fixing belt 21. Further, there is a concern that, when the viewing angle β of the thermopile 46 is widened, according to this, the opening 54 of the heat insulating member 27 needs to be enlarged, heat near the fixing belt 21 is likely to escape to the space at the side of the detecting mechanism 26 via the opening 54 and energy saving performance of the fixing device 18 lowers.

Hence, in the present embodiment, by providing the detecting mechanism 26 in a posture inclined to the posture facing the outer circumferential face of the fixing belt 21, the width in the left and right direction of the detected area D of the fixing belt 21 is made wider than the width in the front and rear direction of the detected area D of the fixing belt 21. By applying such a configuration, when the temperature distribution in the front and rear direction of the fixing belt 21 is not uniform because the temperature distribution in the front and rear direction of the heat generating area H of the halogen lamp 25 is not uniform, it is possible to minimize an influence which this non-uniformity has on a detecting value of the thermopile 46. Consequently, it is possible to enhance the detecting accuracy of the thermopile 46.

Further, the detecting mechanism 26 is arranged in the posture inclined to the posture facing the outer circumferential face of the fixing belt 21 as described above, so that it is possible to sufficiently secure a distance of an optical path of the infrared rays I1 from the outer circumferential face of the fixing belt 21 to the detecting mechanism 26, and prevent the detecting mechanism 26 from greatly protruding toward the outer diameter side of the fixing belt 21 (e.g. the upper side of the fixing belt 21). Consequently, the detecting mechanism 26 hardly interferes other members, and can simplify a layout of the detecting mechanism 26.

Further, in the present embodiment, the width W2 (44 mm) in the front and rear direction of the detected area D of the fixing belt 21 is not less than four times the minimum bright spot width Wmin (10 mm). By applying such a configuration, it is possible to further enhance the detecting accuracy of the thermopile 46. In addition, to enhance the detecting accuracy of the thermopile 46, the width W2 in the front and rear direction of the detected area D is preferably the minimum bright spot width Wmin or more, and is more preferably not less than twice the minimum bright spot width Wmin.

Further, the detecting mechanism 26 is arranged closer to the front side (the outside in the front and rear direction) than the heat generating area H of the halogen lamp 25. By applying such a configuration, it is possible to prevent an influence of the heat of the fixing belt 21 on the detecting mechanism 26 from causing a rise in the temperature of the detecting mechanism 26. According to this, it is possible to set a low heat resistant temperature of the thermistor 48, and heat resistant parts are not necessary. Further, it is possible to prevent the atmospheric temperature of the detecting mechanism 26 from changing and, consequently, enhance the detecting accuracy of the thermistor 48.

Furthermore, the detecting mechanism 26 is housed in the housing 41 and, consequently, can prevent an influence, such as cooling air flowing in the flow passage 55, from changing the atmospheric temperature of the detecting mechanism 26. Consequently, it is possible to further enhance the detecting accuracy of the thermistor 48.

Figure 7:
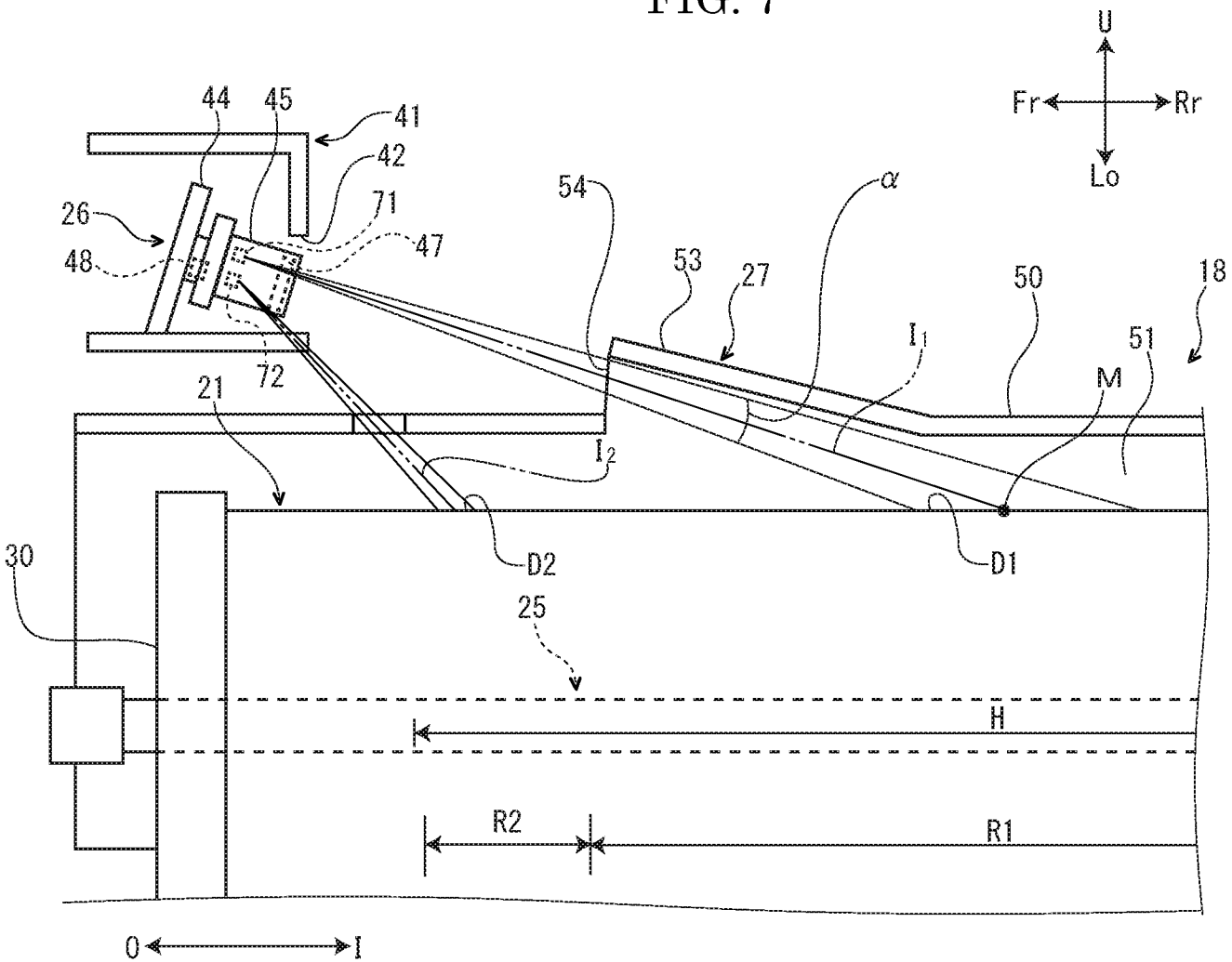
FIG. 7 is a side view showing an upper front part of a fixing device according to one of other embodiments of the present disclosure.
Figure 8:
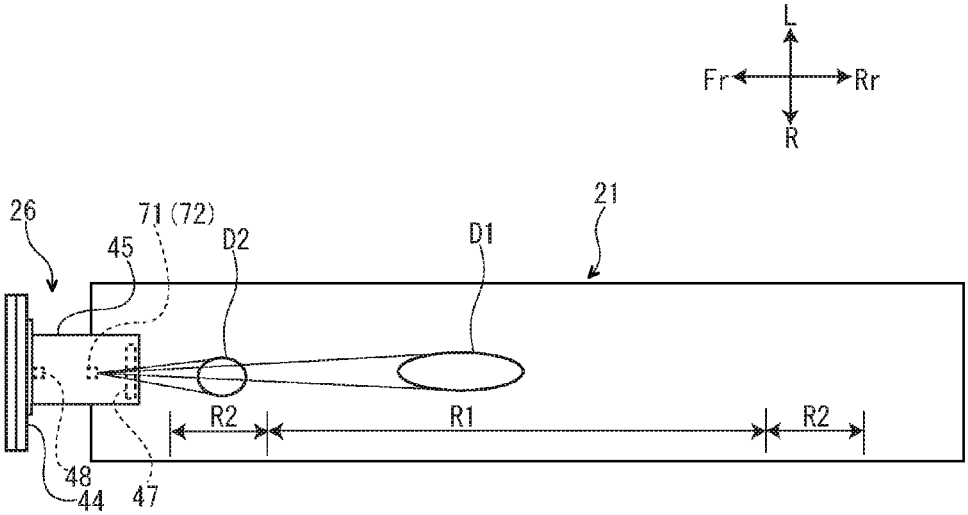
FIG. 8 is a plan view showing a fixing belt and a detecting mechanism, in the fixing device according to the one of the other embodiments of the present disclosure.
Figure 9:
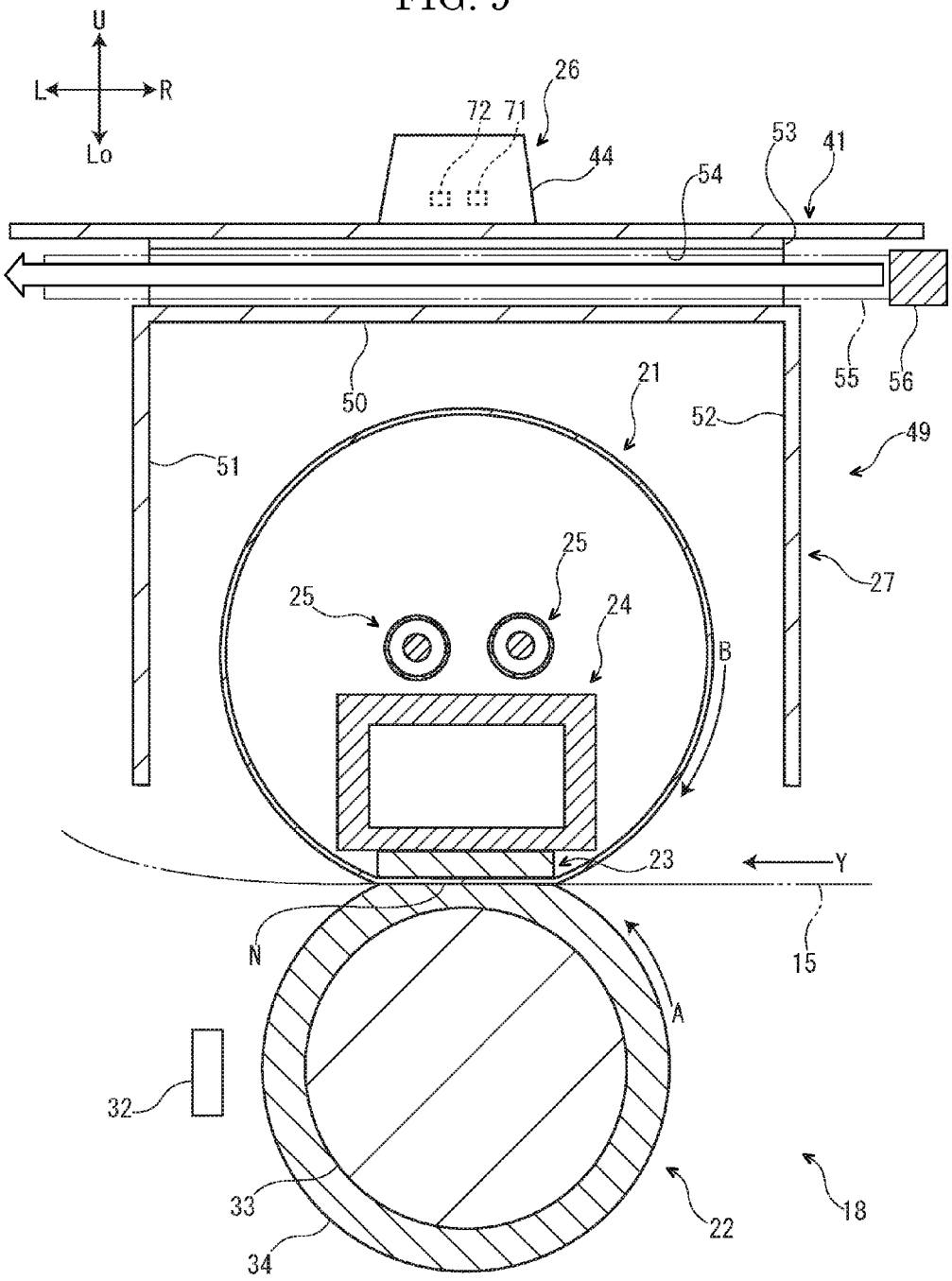
FIG. 9 is a sectional view showing the fixing device according to the one of the other embodiments of the present disclosure.

In the present embodiment, the detecting mechanism 26 has only the single thermopile 46 (infrared detecting element). Meanwhile, in other different embodiments, as shown in FIGS. 7 to 9, the detecting mechanism 26 may include a plurality of thermopiles 71 and 72 (infrared detecting elements), and a plurality of these thermopiles 71 and 72 may include a first thermopile 71 (first infrared detecting element) which detects the infrared rays I1 radiated from the detected area D1 formed in the center area R1 of the fixing belt 21, and a second thermopile 72 (second infrared detecting element) which detects the infrared rays 12 radiated from the detected area D2 formed in the end part area R2 of the fixing belt 21. By applying such a configuration, the single detecting mechanism 26 can detect both of infrared rays radiated from the center area R1 of the fixing belt 21, and infrared rays radiated from the end part area R2 of the fixing belt 21.

In the present embodiment, the fixing device 18 includes one halogen lamp 25. In other different embodiments, as shown in FIG. 9, the fixing device 18 may include a plurality (for example, 2) of the halogen lamps 25 (heat source). In this case, for example, a heat generating area H of one halogen lamp 25 may correspond to the center area R1 of the fixing belt 21 and a heat generating area H of another halogen lamp 25 may correspond to the end part area R2 of the fixing belt 21, and a plurality of the halogen lamps 25 may be selectively lighted up according to detecting values of the first and second thermopiles 71 and 72.

In the present embodiment, each end part area R2 of the fixing belt 21 is an area through which each first size sheet (for example, a maximum size sheet) passes and each second size sheet (for example, a minimum size sheet) does not pass. In other different embodiments, each end part area R2 of the fixing belt 21 may be an area through which no sheet passes.

In the present embodiment, the fixing belt 21 is used as a heating body. In other different embodiments, a fixing roller may be used as a heating body.

In the present embodiment, the halogen lamp 25 is used as a heat source. In other different embodiments, a ceramic heater or the like may be used as a heat source.

In the present embodiment, the configuration of the present disclosure is applied to the printer 1. Meanwhile, in other different embodiments, the configuration of the disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a heating body configured to be rotatable;

a pressuring body configured to be rotatable and to come into pressure contact with the heating body so as to form a fixing nip;

a heat source configured to heat the heating body; and a detecting mechanism configured to be not in contact with the heating body and including an infrared detecting element which detects infrared rays radiated from an outer circumferential face of the heating body, wherein a longitudinal direction of the heating body is a second direction which crosses a first direction as a conveying direction of a recording medium, and a detected area is arranged on the outer circumferential face of the heating body so that the infrared rays radiated from the detected area is detected by the infrared detecting element, and the detecting mechanism is arranged in a posture inclined to another posture facing the outer circumferential face of the heating body so that a width in the second direction of the detected area is wider than a width in the first direction of the detected area, further comprising a heat insulating member arranged between the heating body and the detecting mechanism, wherein the heat insulating member has an opening through which the infrared rays radiated from the outer circumferential face of the heating body passes, and a flow passage of cooling air is arranged between the detecting mechanism and the heat insulating member so that the flow passage is spaced away from the opening.

2. The fixing device according to claim 1, wherein the heat source includes:

a plurality of bright spot parts; and a plurality of dark spot parts which have a smaller heat generating value than the plurality of the bright spot parts, and the width in the second direction of the detected area is not less than twice a width in the second direction of a bright spot part which has the smallest width in the second direction among the plurality of the bright spot parts.

3. The fixing device according to claim 1, wherein the detecting mechanism is arranged at an outside of a heat generating area of the heat source in the second direction.

4. The fixing device according to claim 1, wherein the flow passage is arranged along the first direction.

5. The fixing device according to claim 1, further comprising a fan arranged at an upstream end part of the flow passage, wherein the fan provides the flow passage with the cooling air.

6. The fixing device according to claim 1, wherein a center area and an end part area are arranged on the outer circumferential face of the heating body, the end part area being formed at an outside of the center area in the second direction, and the detecting mechanism has a plurality of infrared detecting elements, and the plurality of the infrared detecting elements include:

a first infrared detecting element configured to detect the infrared rays radiated from the center area; and a second infrared detecting element configured to detect the infrared rays radiated from the end part area.

7. The fixing device according to claim 1, wherein the detecting mechanism further includes:

a lens configured to focus the infrared rays radiated from the outer circumferential face of the heating body on the infrared detecting element; and a temperature detecting element configured to detect an atmospheric temperature of the detecting mechanism, and a temperature of the heating body is calculated on a basis of a detecting value of the infrared detecting element and a detecting value of the temperature detecting element.

8. An image forming apparatus comprising the fixing device according to claim 1.

* * * * *